United States Patent [19]

Jindai et al.

[11] Patent Number: 4,889,466

[45] Date of Patent: Dec. 26, 1989

[54] CONTROL DEVICE FOR A POWER SHOVEL

[75] Inventors: Hideo Jindai, Hirakata; Keiji Bando, Kyoto; Masakazu Yoshida, Kyoto; Hideki Yamada, Kyoto, all of Japan

[73] Assignee: Kabushiki Kaisha Komatsu Seisakusho, Tokyo, Japan

[21] Appl. No.: 44,942

[22] PCT Filed: Jul. 25, 1986

[86] PCT No.: PCT/JP86/00394

§ 371 Date: Mar. 18, 1987

§ 102(e) Date: Mar. 18, 1987

[87] PCT Pub. No.: WO87/00567

PCT Pub. Date: Jan. 29, 1987

[30] Foreign Application Priority Data

Jul. 26, 1985 [JP] Japan ..... 60-165294
Jul. 26, 1985 [JP] Japan ..... 60-165295
Aug. 2, 1985 [JP] Japan ..... 60-170848

[51] Int. Cl.[4] ..... E02F 3/32

[52] U.S. Cl. ..... 414/694; 414/699; 172/4.5

[58] Field of Search ..... 414/687, 694, 699, 695.5, 414/698; 172/2, 4, 4.5; 364/559, 550, 424.01

[56] References Cited

U.S. PATENT DOCUMENTS 3,463,336 8/1969 Mark ..... 414/694
3,717,269 2/1973 Schaeff ..... 414/694
4,129,224 12/1978 Teach ..... 414/698 X
4,140,144 2/1979 Dowd et al. ..... 414/694 X
4,221,266 9/1980 Fardal ..... 172/4
4,288,196 9/1981 Sutton II ..... 172/4.5 X
4,685,861 8/1987 Huetsch ..... 401/15 X
4,699,239 10/1987 Ishino et al. ..... 364/424 X

OTHER PUBLICATIONS

International Publication WO/81/02904, 10/15/81, Bachmann.

*Primary Examiner*—Robert J. Spar
*Assistant Examiner*—Donald W. Underwood
*Attorney, Agent, or Firm*—Spensley Horn Jubas & Lubitz

[57] ABSTRACT

A control device for a power shovel having a first boom, a second boom and an arm rotatable around the longitudinal axis of the arm, detects the angle of the arm with respect to the horizontal plane based on the posture angles of the first and second booms and the arm, and controls the arm cylinder such that the angle of the arm with respect to the horizontal plane is held to a reference angle. Further, the control device detects a deviation angle between the current direction and the initial directions and controls the revolution angle of the arm so as to make the deviation angle zero. Furthermore, the control device designates a moving direction of the connection point between the second boom and the arm along a plane including the first boom, the second boom and the arm, and controls cylinders for the booms such that their connection point may be moved in the moving direction thus designated.

7 Claims, 13 Drawing Sheets

CONTROL DEVICE FOR A POWER SHOVEL

DESCRIPTION

1. Technical Field

The present invention relates to a device for controlling a power shovel having a first boom, a second boom and an arm rotatable around a longitudinal axis of the arm.

2. Background Art

A power shovel of this type has a first boom, a second boom and an arm which is rotatable around the longitudinal axis thereof. Accordingly, it can perform more sorts of operations than a conventional type. For example, it can carry out corner digging by raising a bucket thereof in the vertical direction. And so-called transversal digging by rotating an upper revolving superstructure while the cutting edge of the bucket is kept to be directed toward the transversal direction by rotating the arm.

However, in the corner digging, the first boom and the second boom is operated such that the connection point between the second boom and the arm is moved in the vertical direction, which consequently varies the angle of the arm with respect to the horizontal plane. As a result, the connection point between the arm and the bucket does not move along the vertical line due to the variation of the arm's angle with respect to the horizontal plane. Accordingly, when corner digging is performed, the arm must be operated so that the angle of the arm to the horizontal plane may be held constant.

However, it will impose a heavy burden on an operator to operate the arm while operating the first and second booms concurrently. Moreover, it requires a great deal of skill to carry out appropriately this operation.

In the transversal digging, when the upper revolving superstructure is rotated, the direction of the edge of the bucket varies as the upper revolving superstructure rotates. Accordingly, when forming a straight ditch, the direction of the cutting edge of the bucket should be corrected corresponding to the rotation of the upper revolving superstructure so that the cutting edge of the bucket is directed toward a fixed direction.

In order to correct the direction of the cutting edge of the bucket, the arm should be revolved around the longitudinal axis thereof. However, when forming the straight ditch, the first and second booms and the upper revolving superstructure should be operated, and therefore it will be a heavy burden for an operator to perform a further operation for revolving the arm in addition to the above-mentioned operations.

As described above, when performing the corner digging, the connection point between the second boom and the arm should be moved in the vertical direction. However, it is not easy even for a skillful operator to move the connection point in the vertical direction by operating the first and second booms concurrently. Consequently, in reality, the connection point often deviates from the vertical direction back and forth. This back-and-forth deviation causes the edge of the bucket to move back and forth, so that accurate corner digging cannot be performed.

Furthermore, to form the straight ditch in the transversal digging, the first and second booms are operated so that the connection point is moved along a straight line. However, the bottom of the ditch will be irregular because the height of the connection point is likely to change.

This invention is made to solve the above-described problems in the conventional technology.

DISCLOSURE OF INVENTION

This invention relates to a control device for use in a power shovel having a first boom, a second boom and an arm rotatable around the longitudinal axis of the arm.

The first aspect of this invention comprises: angle detecting means for detecting the posture angles of a first boom, a second boom and an arm; posture angle calculating means for calculating the angle of the arm with respect to the horizontal plane based on the output from the angle detecting means; means for setting a target angle of the arm with respect to the horizontal plane; and control means for controlling an arm cylinder so that the angle of the arm with respect to the horizontal plane may be set to the target angle.

The second aspect of this invention comprises: revolution angle detecting means for detecting a revolution angle of an arm around its longitudinal axis; rotation angle detecting means for detecting rotation angle of an upper revolving superstructure; calculating means for calculating a deviation angle $\Delta A$ of a current direction of the edge of the bucket from the initial direction based on the output of the revolution angle detecting means and the output of the rotation angle detecting means; and arm rotation angle control means for controlling the revolution angle of the arm so that the deviation angle is made to zero.

The third aspect of this invention comprises: angular velocity detecting means for detecting angular velocity of said upper revolving superstructure; and arm rotation control means for rotating the arm in the direction reverse to that of revolution of the upper revolving superstructure at the detected angular velocity.

The fourth aspect of this invention comprises: angle detecting means for detecting the respective posture angles of the first and second booms; moving direction designating means for designating moving direction of the connection point between the boom and the arm on the plane including the first boom, the second boom and the arm; and control means for controlling a first boom cylinder and a second boom cylinder so that the connection point moves along the designated direction based on the output of the designating means.

THE BEST MODE FOR EMBODYING THE INVENTION

Figure 1:
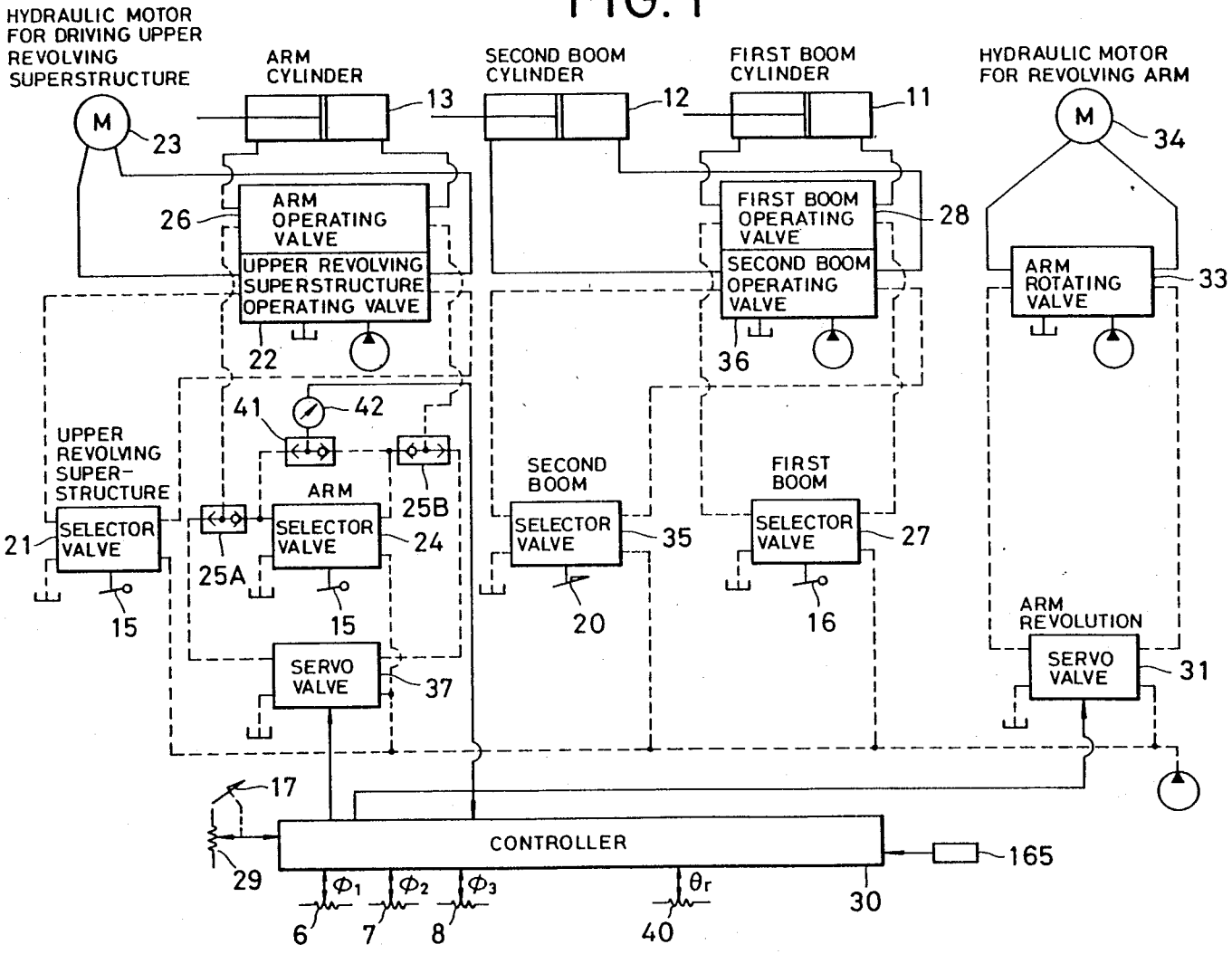
FIG. 1 is a block diagram showing an embodiment of a control device for a power shovel according to this invention.
Figure 2:
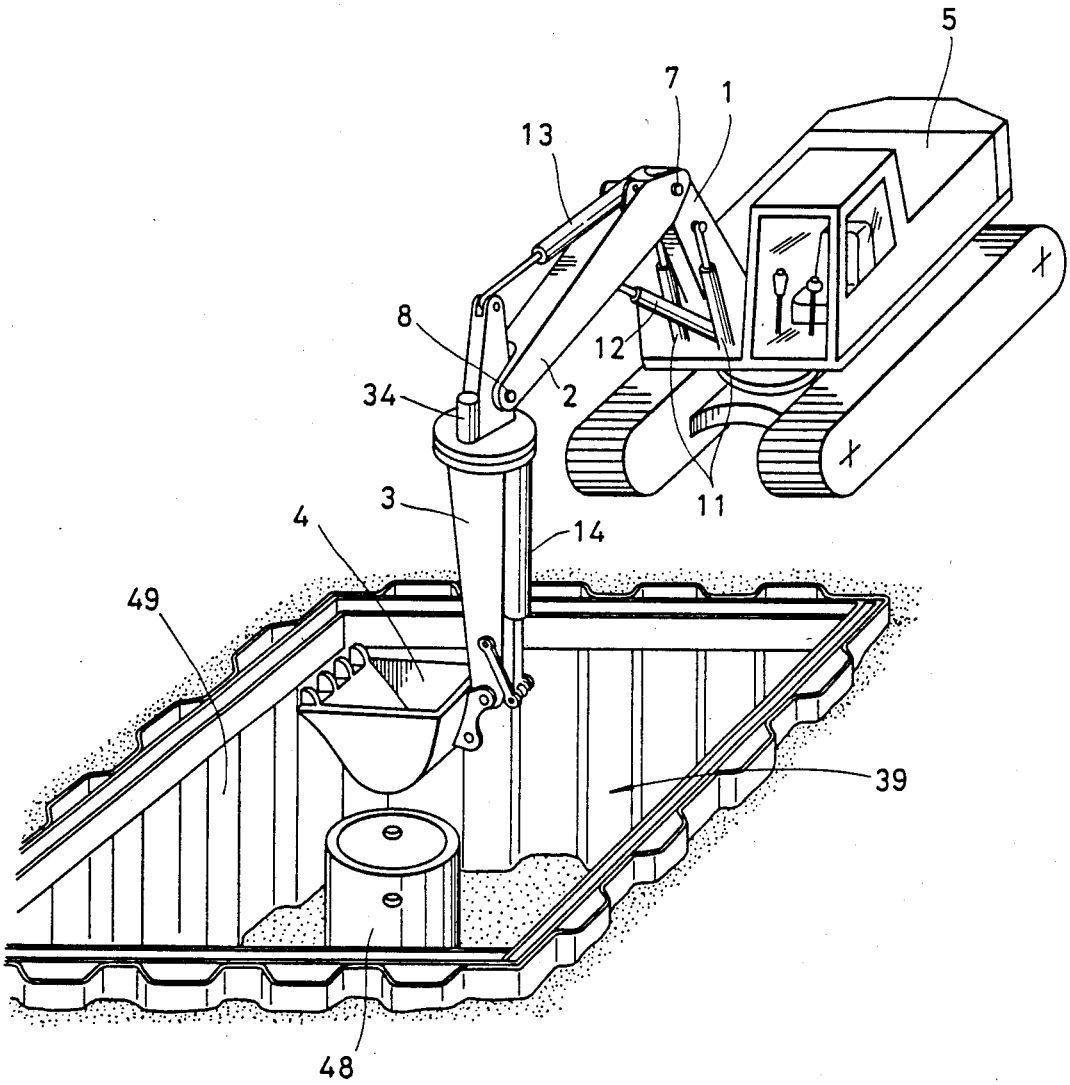
FIG. 2 is a perspective view showing a configuration of a power shovel to which this invention is applied and an example of digging.

FIG. 1 shows an embodiment of the control means according to this invention and FIG. 2 shows a configuration and an operational mode of a power shovel to which this control means is applied.

Figure 3:
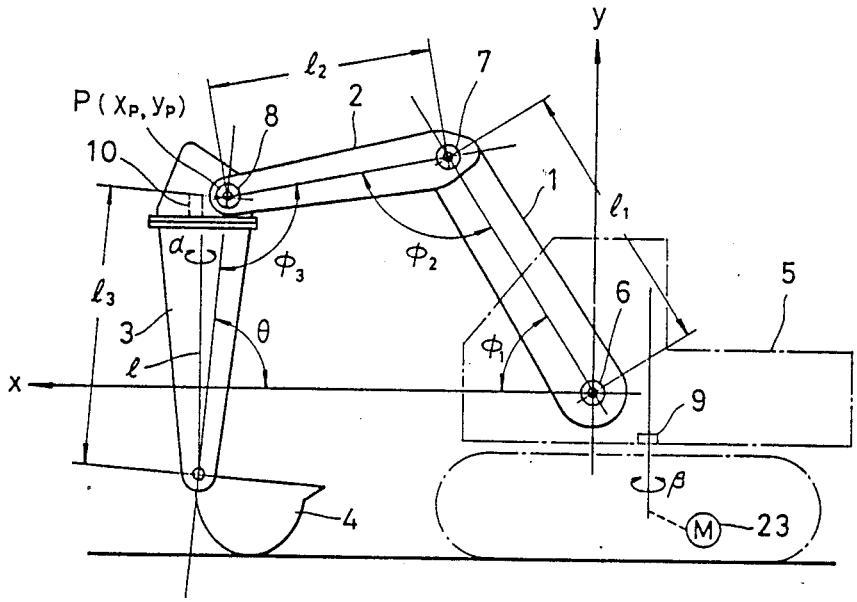
FIG. 3 is a schematic view showing the relation among the posture angles of the first boom, the second boom and the arm.

A power shovel shown in FIG. 2 comprises a first boom 1, a second boom 2, an arm 3 and a bucket 4, the base of the arm 3 being supported by the fore end of the boom 2 so that the arm 3 can be rotated around the longitudinal axis l shown in FIG. 3.

As shown in FIG. 3, at respective rotational fulcrums of the first boom 1, the second boom 2 and the arm 3, there are respectively provided potentiometers 6, 7 and 8 for detecting posture angles of these elements. Furthermore, as shown in FIG. 2, a hydraulic motor 34 for revolving the arm is provided at the base of the arm 3.

The respective posture angles of the first boom 1, the second boom 2, the arm 3 and the bucket 4 are varied by a first boom cylinder 11, a second boom cylinder 12, an arm cylinder 13 and a bucket cylinder 14 shown in FIG. 2.

Figure 4:
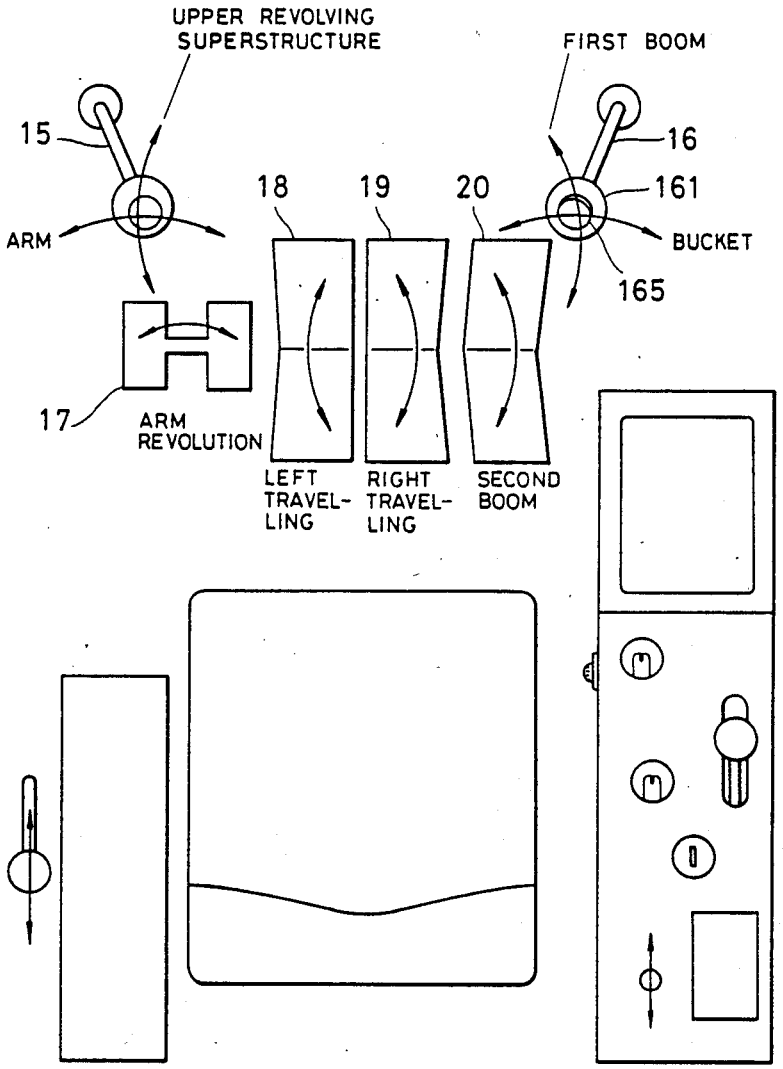
FIG. 4 is a schematic plan view showing the structure of an operator's cab.

FIG. 4 is a plan view showing the interior of an operator's cab installed at an upper revolving superstructure 5. In the operator's cab, two levers 15 and 16 which can be operated back and forth, and left and right, and four pedals 17 to 20 are installed. At the top of a grip portion 161 of a lever 16, a push-button switch 165 for designating automatic mode is provided. The push-button switch 165 is set at the first push and reset at the second push.

The operating physical force of the lever 15 in the back-and-forth direction is transmitted to a selector valve 21. The selector valve 21 applies the output pressure thereof to a revolving superstructure operating valve 22 as a pilot pressure. Accordingly, when the lever 15 is operated in the back-and-forth direction, a hydraulic motor 23 for driving the upper revolving superstructure is normally or reversely rotated at the velocity corresponding to the operated amount of the lever 15.

The operating physical force of the lever 15 in the left-and-right direction is transmitted to a selector valve 24 shown in FIG. 1, thereby supplying the output pressure of the selector valve 24 to an arm operating valve 26 via shuttle valves 25A and 25B as a pilot pressure. Accordingly, when the lever 15 is operated in the left-and-right direction, the arm cylinder 13 is extended or contracted at a velocity corresponding to the operated amount of the lever 15. In other words, the posture angle $\phi_3$ of the arm 3 varies.

The operating physical force in the back-and-forth direction is transmitted to a selector valve 27, thereby applying the output pressure of the selector valve 27 to a first boom operating valve 28 as a pilot pressure. Accordingly, when the lever 16 is operated in the back-and-forth direction, the first boom cylinder 11 is extended or contracted at a speed corresponding to the operated amount. In other words, the posture angle of the first boom 1 varies.

The operating physical force of the lever 16 in the left and right direction is transmitted to a selector valve (not shown), thereby pilotting a bucket operating valve (not shown) by the output pressure of the selector valve to drive the bucket.

The motion of the pedal 17 is transmitted to a potentiometer 29 shown in FIG. 1, thereby outputting a signal having a polarity corresponding to the stepped direction of the pedal and a value corresponding to the stepped amount. The signal is supplied to a servo valve 31 after being processed, e.g. amplified, by a controller 30. Accordingly, the stepping operation of the pedal 17 drives the motor 34 for rotating the arm, thereby revolving the arm 3 around the above-mentioned axis l.

The arm 3 is revolved counterclockwise or clockwise respectively, when the left end or right end of the pedal 17 is stepped.

The motion of a pedal 20 is transmitted to a selector valve 35. The output pressure of the valve 35 acts on a second boom operating valve 36 as a pilot pressure. The second boom cylinder 12 is extended or contracted at a speed corresponding to the stepped amount of the pedal 20 when the pedal 20 is stepped at rear end or fore end. In other words, the posture angle $\phi_2$ of the second boom varies.

Pedals 18 and 19 are operated respectively when the travelling directions and the travelling speeds of a left travelling system and a right travelling system are varied.

Figure 5:
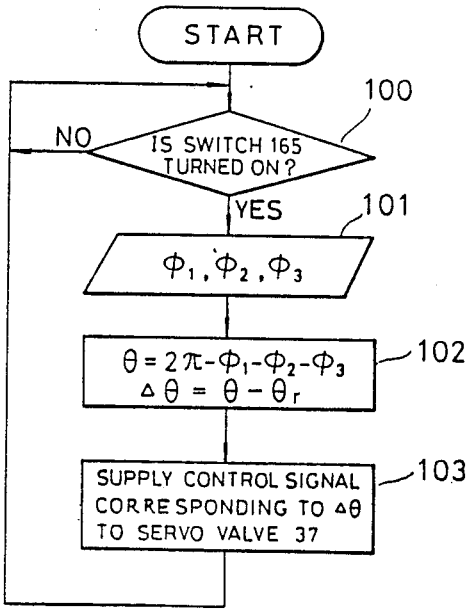
FIG. 5 is a flowchart showing an operational procedure of the controller shown in FIG. 1.

FIG. 5 shows an operational procedure of the controller 30 based upon the respective outputs from potentiometers 6 to 8 and a push-button switch 165 mounted on the lever 16.

The principle and functions of this embodiment will be described hereinafter.

As apparent from FIG. 3, assuming that the angle of the arm with respect to a horizontal plane (shown by x-axis) is $\theta$, the relation described by equation $\phi_1+\phi_2+\phi_3+\phi=2\pi$ is established, so that the angle $\theta$ is obtained by the following equation (1).

$$\theta=2\pi-\phi_1-\phi_2-\phi_3 \quad (1)$$

Accordingly, assuming that the target angle of the arm 3 with respect to the horizontal plane is $\theta_r$ when the arm cylinder 13 is controlled such that the deviation $\Delta\theta$ of the actual arm angle $\theta$ obtained by the equation (1) from the target angle $\theta_r$ $$\Delta\theta=\theta_r-\theta \quad (2)$$

is made to zero, the angle $\theta$ of the arm 3 with respect to the horizontal plane can be held to the target angle $\theta_r$.

In this embodiment, the arm 3 is controlled based on the above-mentioned principle so that the arm angle $\theta$ may be held to the target angle $\theta_r$.

At the controller 30, first of all, at step 100 shown in FIG. 5, it is judged whether or not the switch 165 is turned on, that is, whether or not the automatic mode is selected. Where the automation mode has been selected by depressing the switch 165, the posture angles $\phi_1$, $\phi_2$ and $\phi_3$ of the first boom 1, the second boom 2 and the arm 3 are inputted into the controller 30 (step 101), and then the arithmetic operation expressed by the equations (1) and (2) is executed (step 102).

Subsequent to the above operation, at the controller 30, a control signal corresponding to the angular deviation $\Delta\theta$ is produced, the control signal in turn being added to a servo valve 37 (step 103).

Since the output pressure of the servo valve 37 acts on the arm operating valve 26 via the shuttle valves 25A and 25B as a pilot pressure, the arm cylinder 13 is driven in the direction in which the above-mentioned angular deviation $\Delta\theta$ is made to zero, thereby holding the angle $\theta_r$ of the arm 3 with respect to the horizontal plane to the target angle $\theta_r$.

Since this embodiment has the above-described function, when digging the corner portion of a ditch 39 with the bucket 4 turned in the side direction of the arm 3 by 90°, the angle $\theta$ of the arm 3 to the horizontal plane can be always held to a target angle $\theta_r$ regardless of the posture angles $\phi_1$ and $\phi_2$ of the first boom 1 and the second boom 2. Consequently, the bucket 4 is moved in the vertical direction from the bottom of the ditch 39 by operating the first boom 1 and the second boom 2 so that the connection point P (refer to FIG. 3) connecting the arm 3 to the second boom 2 may be moved upward along a vertical line.

In other words, according to this embodiment, the corner portion can be dug appropriately only by operating the first boom 1 and the second boom 2, so that the burden of the operator is lightened by the degree that the correcting operation for the angle of the arm 3 can be omitted.

The above-mentioned target posture angle $\theta_r$ can be arbitrarily determined by a setter 40 shown in FIG. 1. When digging the corner portion as shown in FIG. 2, the target posture angle $\theta_r$ is usually determined to $\theta_r=90°$.

The embodiment is explicitly applicable to the case where the corner digging is executed with the cutting edge of the bucket 4 turned toward the upper revolving superstructure 5 as shown in FIG. 3.

Incidentally, in order to switch the automatic mode to the manual mode, the push-button switch 165 should be pushed again. However, when the arm cylinder 13 is to be operated urgently or when the posture angle $\phi_3$ is to be corrected temporarily, it would be convenient to set a manual interruption to the arm cylinder 13 during the automatic mode.

A shuttle valve 41 and a pressure switch 42 are installed for this purpose. Under the state that the automatic mode is selected, when the switching valve 24 is manually operated by the lever 15, the output pressure from the one output port or the other of the valve 24 is added to the pressure switch 42 via the shuttle valve 41 so that the above-mentioned pressure switch is turned on. Accordingly, an on-signal outputted from the pressure switch 42 indicates that the selector valve 24 is manually operated.

Accordingly, by cutting off the control signal to the servo valve 37 cut at the controller 30 based on the on-signal outputted from this pressure switch 42, the automatic control of the arm cylinder 13 is interrupted and the manual control is made possible. When the lever 15 is turned back to the neutral position, the pressure switch 42 is turned off and the automatic control is resumed.

The power shovel of this type can execute socalled transversal digging by revolving the revolving superstructure 5 with the bucket turned in the side direction.

When executing the transversal digging, the direction of the cutting edge of the bucket 4 as the upper revolving superstructure 5 rotates. In other words, assuming that the initial rotation angle of the arm 3 is determined to $-60°$ and the initial rotation angle $\beta$ of the revolving superstructure is determined to 60°, when the upper revolving superstructure is revolved by the angle $\Delta\beta=30°$, the direction of the cutting edge of the bucket 4 is varied by the rotation angle $\Delta\beta$ of the revolving superstructure 5 from the initial direction.

Figure 6:
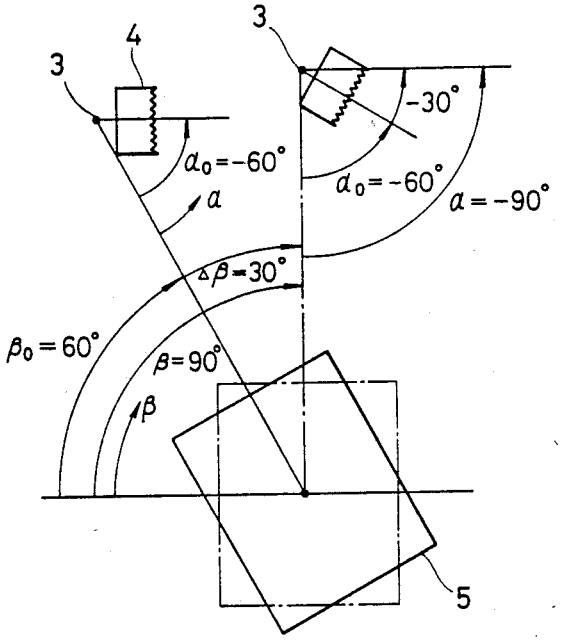
FIG. 6 is a conceptional view showing the directional change of the cutting edge of a bucket as the upper revolving superstructure rotates.

In FIG. 6, the revolution angle $\alpha$ is determined to be positive and negative when the arm 3 is revolved clockwise and counterclockwise, respectively. When the upper revolving superstructure 5 is rotated clockwise from the reference position, the rotation angle $\beta$ is determined positive, and when rotated counterclockwise, it is determined negative.

As is obvious from FIG. 6, in order to keep the cutting edge of the bucket 4 toward the initial direction regardless of the rotation of the upper revolving superstructure 5, the revolution angle $\alpha$ of the arm 3 should be determined to $\alpha_0-\Delta\beta$.

Since the rotation angle $\Delta\beta$ of the upper revolving superstructure 5 from the initial revolution angle $\beta_0$ is expressed $\beta-\beta_0$, the deviation $\Delta A$ of the actual arm revolution angle a from the target angle $(\alpha_0-\beta+\beta_0)$, with using $\alpha_0-\Delta\beta=\alpha_0-\beta+\beta_0$ as a target angle of revolution angle $\alpha$ of the arm 3, can be expressed as follows:

$$\Delta A=(\alpha_0-\beta+\beta_0)-\alpha=(\alpha_0+\beta_0)-(\alpha+\beta)=A_0-A \qquad (3)$$

where $A_0$; $\alpha_0+\beta_0$

A; $\alpha+\beta$

Therefore, by controlling the revolution of the arm 3 such that the derivation $\Delta A$ may be zero, the cutting edge of the arm 3 is always directed toward the initial direction.

Figure 8:
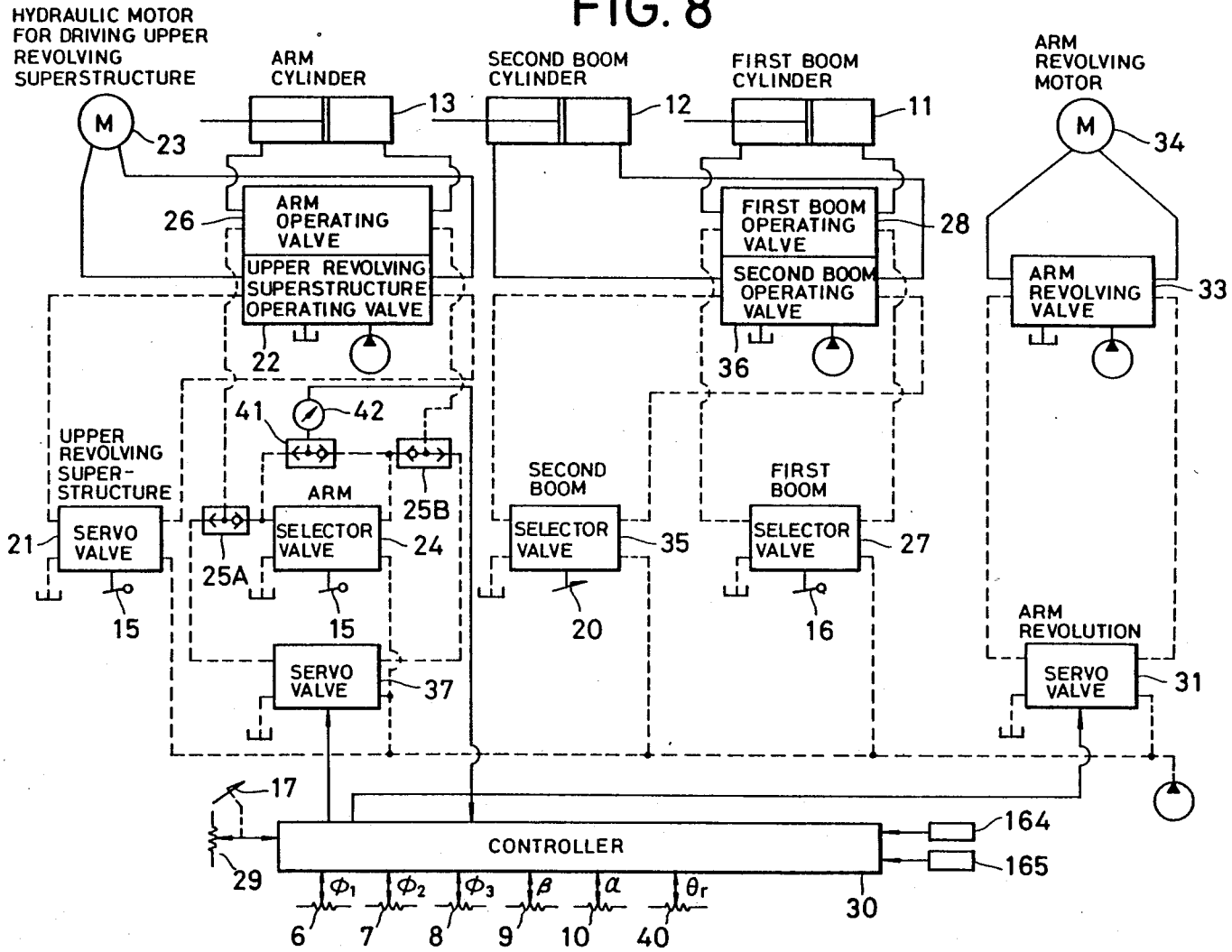
FIG. 8 is a block diagram showing an embodiment of the second aspect of this invention.

FIG. 8 shows an embodiment of this invention in which the cutting edge of the bucket 4 is maintained toward the initial direction based on the foregoing consideration.

In this embodiment, thee are provided a potentiometer 9 for detecting the revolution angle $\beta$ of the upper revolving superstructure 5 and a potentiometer 10 for detecting revolution angle $\alpha$ of the arm 3 around the axis l shown in FIG. 3. In this embodiment, as shown in FIG. 9, the configuration of the grip portion 161 of the lever 16 is different from that of the lever 16 shown in FIG. 4.

Figure 9:
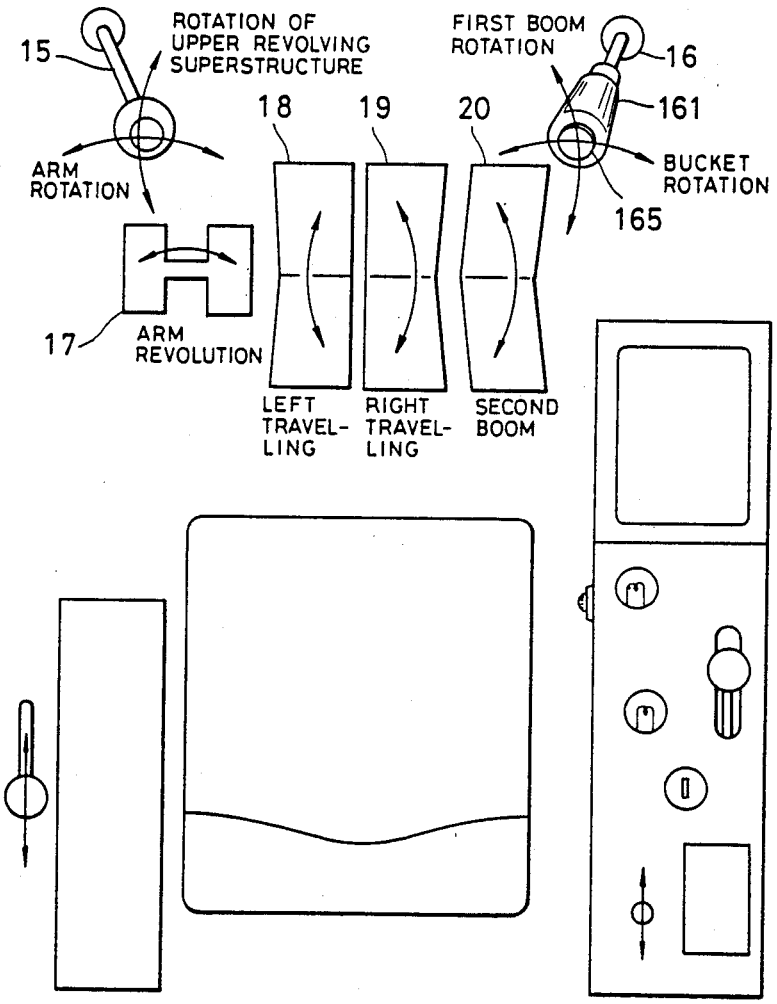
FIG. 9 is a schematic view showing the external appearance of a lever.
Figure 10:
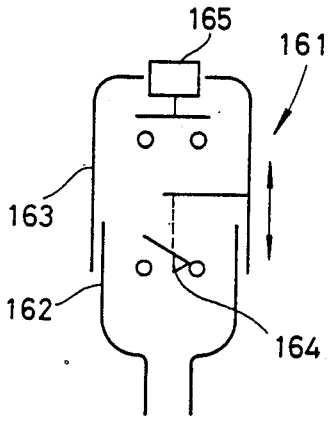
FIG. 10 is a schematic view showing a configuration of a grip portion of the lever.

As schematically shown in FIG. 10, the grip portion 161 shown in FIG. 9 is composed of a lower grip member 162, an upper grip member 163 slidably engaged with the lower grip member 162, a microswitch 164 disposed inside the member 162, a push-button switch 165 disposed on the top of the member 163.

The microswitch 164 in the grip portion 161 is closed when the upper grip member 163 is slided against the repelling force of a spring not shown in the drawing. The push-button switch 165 is set at the first action and reset at the second action.

Figure 11:
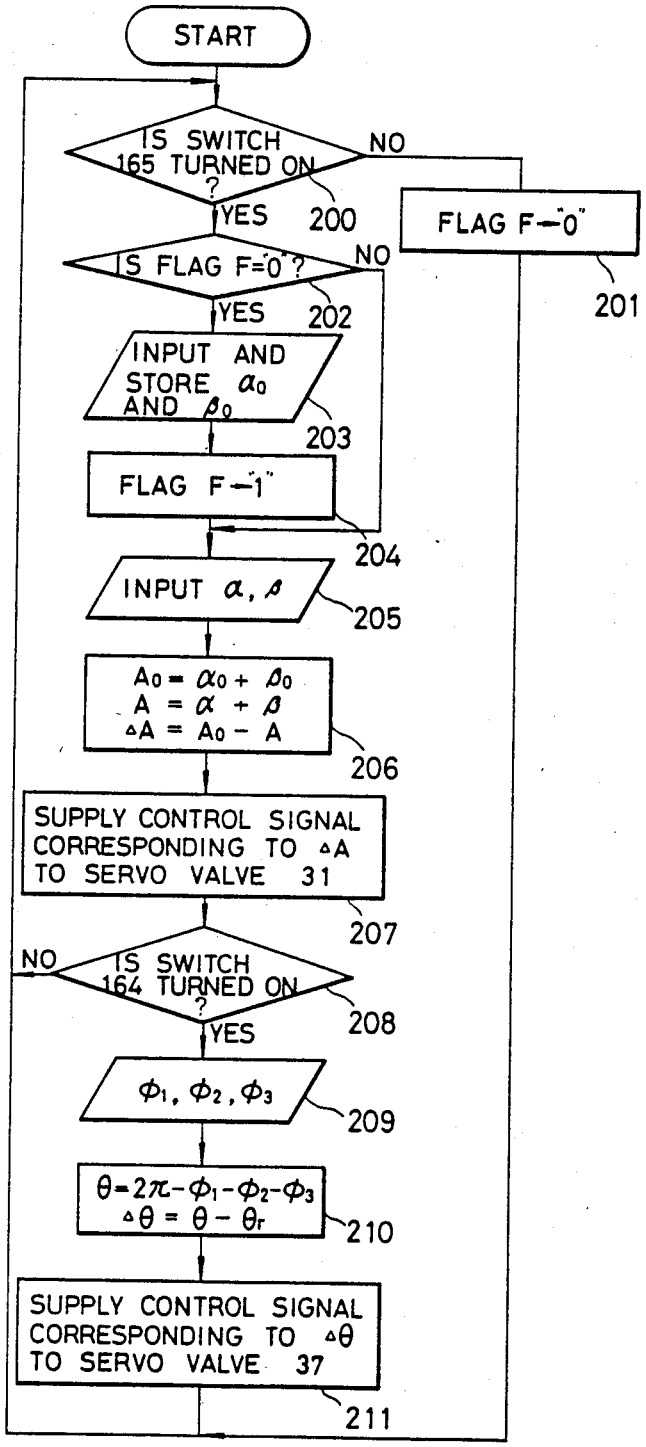
FIG. 11 is a flowchart showing the operational procedure of a controller shown in FIG. 8.

In this embodiment, procedures shown in FIG. 11 are executed by the controller 30. More particularly, first of all, at step 200, whether the switch 165 is turned on, that is, whether automation mode is selected, is judged. When the result is NO, flag F is set to "0" (step 201).

When the switch 165 is depressed and the result of judgment at step 200 is YES, a judgment is made as to whether flag F is "0" or not (step 202). Since F ="0" at this point, the initial revolution angle $\alpha_0$ of the arm 3 and the initial revolution angle $\beta_0$ of the upper revolving superstructure 5 are inputted respectively into a memory not shown in the drawing. Incidentally, these angles $\alpha_0$ and $\beta_0$ are detected based on the outputs of potentiometers 10 and 9. In case of an example shown in FIG. 6, $\alpha_0=-60°$ and $\beta_0=60°$.

At step 204, flag "F" is set to "1", and then at step 205, the rotation angle $\alpha$ of the arm 3 and the revolution angle $\beta$ of the upper revolving superstructure 5 at this point of time are inputted. After that, at step 206, operations $A_0=\alpha_0+\beta_0$ and $A=\alpha+\beta$ included in the equation (3), and an operation to calculate the difference $\Delta A$ between the results of these operations $\Delta A=A_0-A$ are executed.

Incidentally, in case of FIG. 6, $A_0=-60°+60°=0$. In order to facilitate the understanding of this, supposing that the rotation angle $\alpha$ of the arm 3 is made $\alpha=\alpha_0=-60°$ when the upper revolving superstructure 5 is rotated by $\Delta\beta=30°$, then $A=-60°+(60°+30°)=30°$, and consequently $\Delta A=0°-30°=-30°$.

The difference $\Delta A$ represents the deviation angle between the initial and the current directions of the cutting edge of the bucket 4. At step 207, a control signal corresponding to the difference $\Delta A$ is produced and the signal is applied to the arm revolving servo valve 31. Consequently, the arm rotating motor 34 is driven to make the deviation angle $\Delta A$ zero.

According to the example shown in FIG. 6, since $\Delta A=-30°$, the control signal corresponding to $-30°$ is applied to the servo valve 31, thereby revolving the arm 3 counterclockwise around the axis l shown in FIG. 3. When the arm 3 is revolved to the point at which $\Delta A$ becomes zero, the revolution of the arm 3 is halted. At this time, the direction of the cutting edge of the bucket 4 coincides with its initial direction.

In actual operations, the correction control of the deviation angle A is executed concurrently with the rotation of the upper revolving superstructure 5 so that the cutting edge of the bucket 4 is always directed toward its initial direction.

At step 208, a judgment is made as to whether or not the microswitch 164 mounted on the grip portion 161 is operated. Since the result of this judgment is NO at this time, the procedure is returned to step 200.

Figure 7:
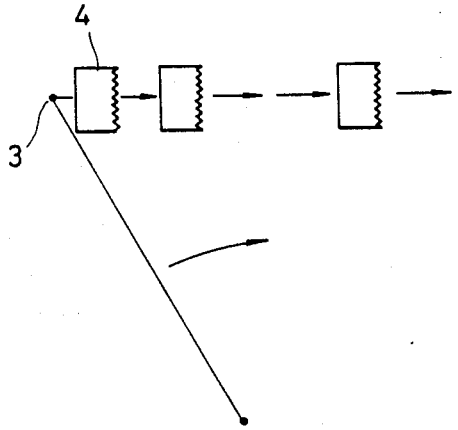
FIG. 7 is a conceptional view showing a manner in which a straight ditch is dug.

Thus, according to this embodiment, regardless of the rotation angle of the revolving superstructure 5, the revolution angle of the arm 3 is automatically controlled such that the cutting edge of the bucket is directed toward the initial direction. Accordingly, when digging a straight ditch in the transversal direction as shown in FIG. 7, it is unnecessary to revolve the arm 3.

When the initial revolution angle $\alpha_0$ of the arm 3 and the initial rotation angle $\beta_0$ of the upper revolving superstructure 5 are inputted, flag F is set to "1". Accordingly, the procedure of the controller 30 jumps from step 202 to step 205 so that the current revolution angle $\alpha$ of the arm 3 and the current rotation angle of the upper revolving superstructure 5 are inputted.

Figure 12:
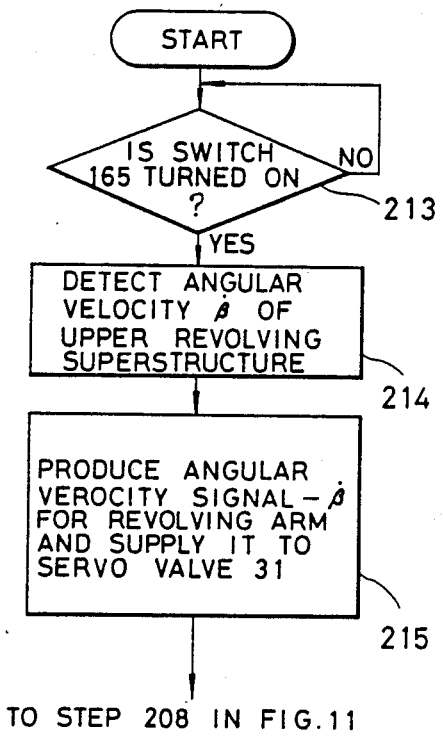
FIG. 12 is a flowchart showing an embodiment of the third aspect of this invention.

In the foregoing embodiment, the cutting edge of the bucket 4 is caused to be directed toward the initial direction by calculating the deviation angle $\Delta A$ at step 206 in FIG. 11 and rotating the arm 3 toward the direction in which the deviation A is made zero. However, the same effect as mentioned above can be obtained by executing procedures shown in FIG. 12.

In this procedure, a judgment is made as to whether or not the switch 165 is turned on (step 213). When the switch is turned on, the revolution angular velocity $\dot{\beta}$ of the upper revolving superstructure 5 is detected (step 214). At step 215, an angular velocity command for rotating the arm 3 in the direction reverse to that of the revolution of the revolving superstructure 5 at the same velocity as the angular $\dot{\beta}$ is produced and supplied to the servo valve 31.

Through this procedure, the arm 3 is rotated in the direction reverse to that of the upper revolving superstructure 5 by an angle equal to the angle variation of the upper revolving superstructure 5 after the switch 165 is turned on. By means of this operation, the cutting edge of the bucket 4 can be directed toward the initial direction.

The rotation angle velocity $\dot{\beta}$ of the upper revolving superstructure 5 is detected, for example, by differentiating the output of the potentiometer 9.

There will be described hereinafter the case where the grip member 163 of the grip portion 161 is slided so that the microswitch 164 is turned on, in other words, that the result of the judgment at step 208 is YES.

In this case, procedures 209 to 211 similar to the procedures 101 to 103 shown in FIG. 5 are executed by the controller 30. In other words, the angle $\beta$ of the arm 3 with respect to the horizontal plane is controlled to be held to the target angle $\theta_r$.

When digging a transversal ditch, the following advantages lie in executing the steps shown in steps 209 to 211. When the transversal digging shown in FIG. 7 is executed, since the first boom 1 and the second boom 2 are operated in the transversal digging, the angle variation of the arm 3 with respect to the horizontal plane caused by the operation of these booms should be corrected. However, since by executing the procedures of steps 209 to 211, the angle $\theta$ of the arm 3 with respect to the horizontal plane can be kept to the target angle $\theta_r$ independent of the variation of the posture angles $\phi_1$ and $\phi_2$ caused by the operations of the booms 1 and 2, it is unnecessary to correct the angle of the arm 3.

Providing a manual interruption which enables to rotate the arm manually (in the $\alpha$ direction) during the automatic mode in which the push-button switch 165 is turned on will be advantageous to manually revolve the arm 3 in case of emergency and temporarily correct the arm rotation angle.

In order to make possible the manual interruption for the arm rotation, a manual operation priority function should be provided in the controller 30. More particularly, the manual interruption is carried out, when the pedal 17 shown in FIG. 9 is operated, the control signal produced at step 207 is interrupted and the manual control signal based on the output of the potentiometer 29 shown in FIG. 8 is applied to the servo valve 31 instead of the control signal.

In this embodiment, by utilizing the output of the pressure switch 42 shown in FIG. 8, the manual interrupting operation to the arm cylinder 13 (an operation to vary the posture angle $\phi_3$) is made possible.

Supposing that an x-y coordinate system is established on a plane including the first boom 1, the second boom 2 and the arm 3 with the origin of the coordinate system being on the rotation fulcrum of the first boom 1 shown in FIG. 3, the coordinates ($X_p$, $Y_p$) of the connection point P (the fore end of the second boom) between the second boom 2 and the arm 3 are obtained by the following equations (4) and (5).

$$X_p = l_1 \cos\phi_1 - l_2 \cos(\phi_1+\phi_2) \quad (4)$$

$$Y_p = l_2 \sin\phi_1 - l_2 \sin(\phi_1+\phi_2) \quad (5)$$

where $l_1$: length of the first boom $l_2$: length of the second boom

When executing the above-mentioned corner digging by vertically raising the bucket 4, or when scraping the soil attached on the outer peripheral surface of the clay pipe shown in FIG. 2 by means of the cutting edge of the bucket 4, the connection point P should be moved only in the y direction (the vertical direction). The reason is that when raising the bucket 4 by operating the first boom cylinder 11 and the second boom cylinder 12, the movement of the connection point P in the x direction may cause such disadvantages as the variation of the digging position, touch of the bucket 4 on the side board 47, and thrust or detachment of the cutting edge of the bucket 4 to or from the peripheral surface of the clay pipe 48.

When rotating the upper revolving superstructure 5 while the first boom cylinder 11 and the second boom cylinder 12 are fixed, the locus of the moving connection point P naturally becomes an arc. Accordingly, as shown in FIG. 7, when digging a straight ditch with the cutting edge of the bucket 4 directed toward the side direction, it is necessary to make the locus straight. For this purpose, the connection point P should be operated so as to adjust the position of the connection point P in the x direction (in the horizontal direction) as the upper revolving superstructure 5 rotates.

The position of the connection point P is varied in the x direction by operating the first boom cylinder 11 and the second boom cylinder 12. Since the position of the cutting edge of the bucket 4 moves up and down during the operation corresponding to the movement of the connection point P in the y direction, the cylinders should be operated under the condition of $y_p$=constant.

Furthermore, when executing a so-called bank cutting, it is necessary to move the connection point P along the normal surface to be formed. When forming, for example, a normal surface of 45°, the connection point P should be moved in the x and y directions at the same speed.

Figure 13:
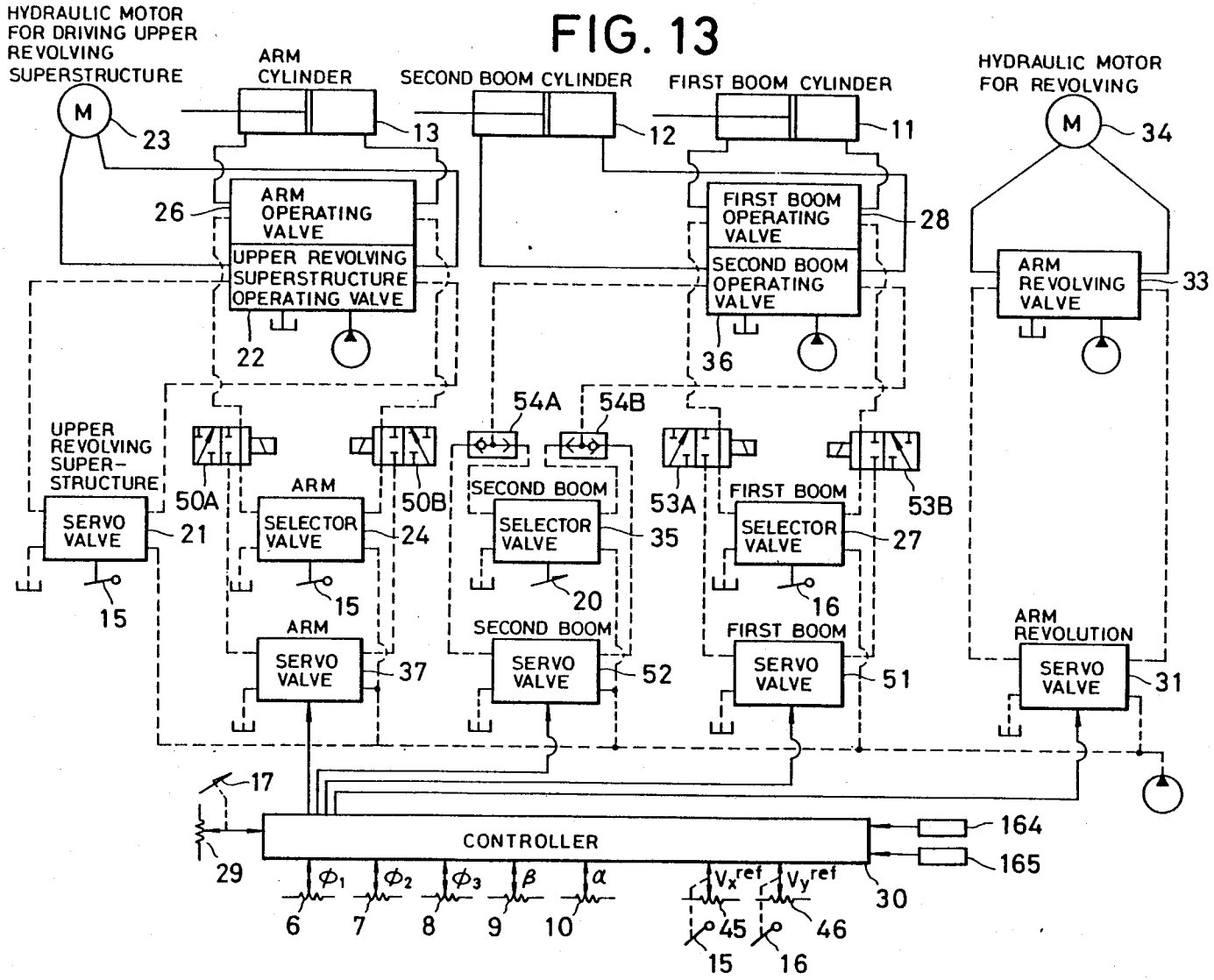
FIG. 13 is a block diagram showing an embodiment of the fourth aspect of this invention.

FIG. 13 shows an embodiment in which the moving direction of the connection point P can be easily designated. As will be described later, in this embodiment, corner digging, transversal digging and normal surface digging and the like are easily and accurately executed.

Figure 14:
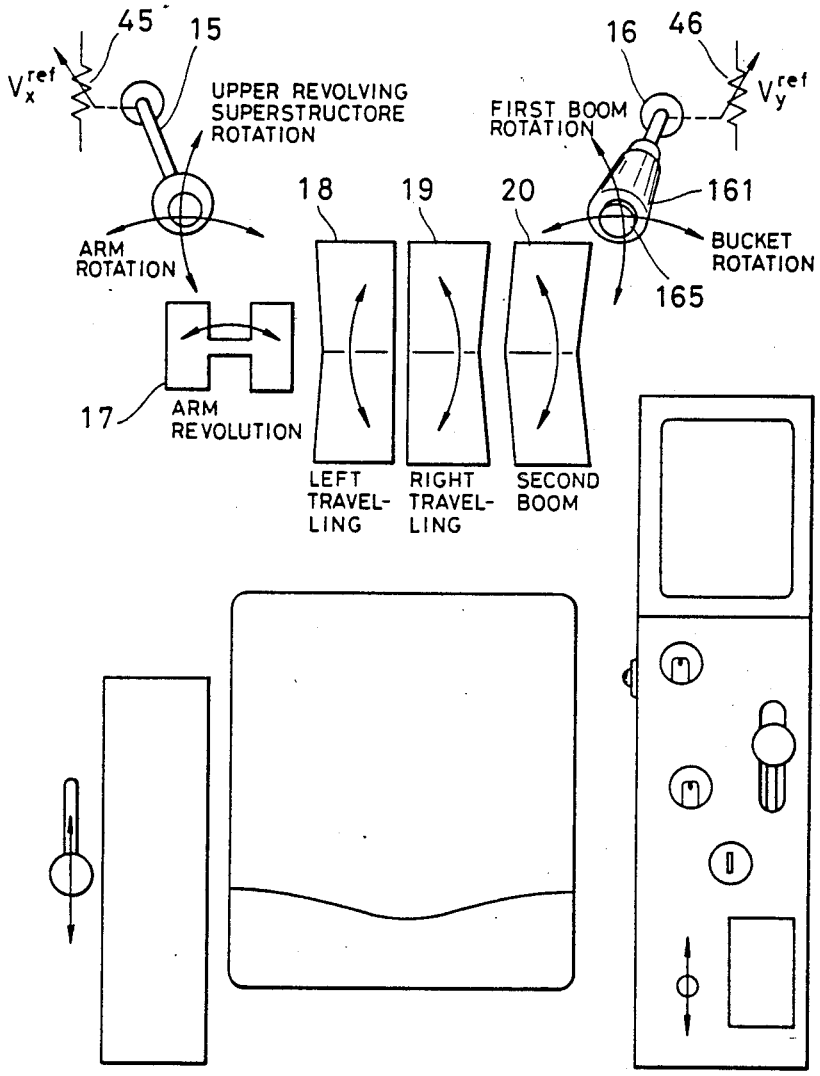
FIG. 14 is a schematic view in which a potentiometer is provided on the respective levers.

In the embodiment shown in FIG. 13, as shown in FIG. 14, there are provided a potentiometer 45 linking to the operation of tho lever 15 in the left-and-right direction and a potentiometer 46 linking to the operation of the lever 16 in the back-and-forth direction. The output signals of the potentiometers 45 and 46 are supplied to the controller 30 shown in FIG. 13 as signals representing x-direction reference velocity $V_y^{ref}$ and y-direction reference velocity $V_y^{ref}$ of the connection point P during the automatic mode which will be described later.

In this embodiment, there are further provided electromagnetic selector valves 50A and 50B for switching between control by the switching valve 24 and control by the selector valve 37 and servo valves 51 and 52 for electrically controlling the first boom cylinder 11 and the second boom cylinder 12. Furthermore, there are provided electromagnetic selector valves 53A and 53B for selecting either one of the control by the selector valve 27 and the control by the servo valve 51 as well as shuttle valves 54A and 54B for preventing interference between the output pressures of a selector valve 35 and the servo valve 52.

Figure 15:
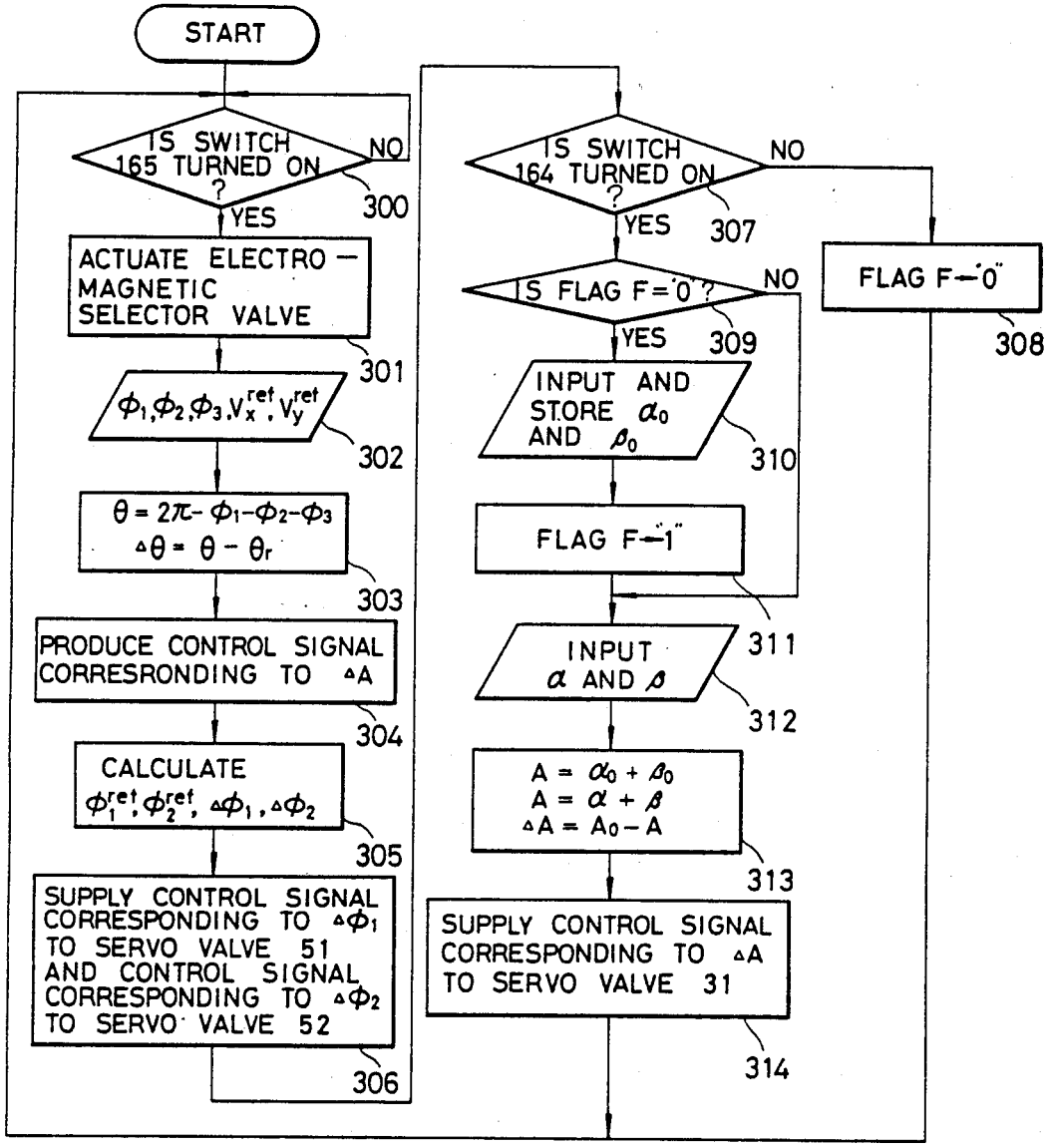
FIG. 15 is a flowchart showing an operational procedure of a controller shown in FIG. 13.

The function of this embodiment will be described in reference to FIG. 15 showing the procedure of the controller 30.

In the controller 30, a judgment is made as to whether or not the switch 15 of the grip portion 161 is turned on, that is, whether or not automatic mode is selected. When the result of the judgment is YES, the electromagnetic selector valves 50A, 50B and 53A, 53B are switched respectively (step 301).

To the controller 30, posture angles $\phi_1$, $\phi_2$ and $\phi_3$ of the first boom 1, the second boom 2 and the arm 3 are inputted based on the outputs of the potentiometers 6, 7 and 8, and the x-direction reference velocity $V_x^{ref}$ and the y-direction reference velocity $V_y^{ref}$ which will be described later are inputted based on the output of the potentiometers 45 and 46 (step 302). Subsequently, steps 303 and 304 similar to steps 102 and 103 shown in FIG. 5 are sequentially executed, thereby holding the angle $\theta$ of the arm 3 with respect to the horizontal plane to the target angle $\theta_r$.

Supposing that a velocity vector ($V_x^{ref}$, $V_y^{ref}$) of the connection point P is expressed by the output of the potentiometers 45 and 46, the sampling time for this velocity vector is $\Delta T$ and the current position of the connection point P is ($x_{po}$, $y_{po}$), cordinates ($x_p^{ref}$, $y_p^{ref}$) are approximately expressed as follows:

$$x_p^{ref} = V_y^{ref} \times \Delta T + x_{po} \quad (6)$$

$$x_p^{ref} = V_y^{ref} \times \Delta T + y_{po} \quad (7)$$

The above equations express the position of the connection point P which is estimated to reach after $\Delta T$. By sequentially operating the first boom 1 and the second boom 2 utilizing the estimated position obtained at each sampling as a target position, the connection point P is moved at the speed and in the direction shown by the velocity vector.

Since the movement of the connection point P to the target position expressed by the equations (6) and (7) is executed by varying the posture angle $\phi_1$ and $\phi_2$ of the first boom 1 and the second boom 2, in an actual control, it is necessary to convert the target position into the posture angle $\phi_1$ of the first boom and the posture angle $\phi_2$ of the second boom corresponding to the target angle.

A method for this conversion will be described hereinafter. The equations (4) and (5) are transformed as follows:

$$l_2 \cos(\phi_1+\phi_2) = l_2 \cos\phi_1 - x_p \quad (4)'$$

$$l_2 \sin(\phi_1+\phi_2)=l_1 \sin \phi_1 - y_p \quad (5)'$$

By squaring both sides of the respective equations and adding the corresponding sides to each other, these equations become as follows.

$$\begin{aligned} l_2^2 &= x_p^2 + y_p^2 + l_1^2 - 2l_1 (x_p\cos\phi_1 + y_p\sin\phi_1) \\ &= x_p^2 + y_p^2 + l_1^2 - 2l_1 \sqrt{x_p^2 + y_p^2} \sin(\phi_1 + \phi) \end{aligned}$$

where $\tan \phi = \frac{y_p}{x_p}$

Thus, the following equation is obtained:

$$\sin(\phi_1 + \phi) = \frac{x_p^2 + y_p^2 + l_1^2 - l_2^2}{2l_1 \sqrt{x_p^2 + y_p^2}}$$

From the equation, $\phi_1$ is expressed as the following equation (8):

$$\phi_1 = \sin^{-1}\left\{ \frac{x_p^2 + y_p^2 + l_1^2 - l_2^2}{2l_1 \sqrt{x_p^2 + y_p^2}} \right\} - \tan^{-1} \frac{y_p}{x_p} \quad (8)$$

Furthermore, $\phi_2$ is expressed from the equation (4) as follows:

$$\phi_2 = \cos^{-1}\left( \frac{l_1\cos\phi_1 - x_p}{l_2} \right) - \phi_1 \quad (9)$$

By substituting $\phi_1$ expressed in the equation (8) into the equation (9), $\phi_2$ is expressed as a function of $x_p$ and $y_p$.

Therefore, by substituting the reference position ($x_p^{ref}$, $y_p^{ref}$) expressed by the equations (6) and (7) into the equations (8) and (9), the reference position can be converted into the reference posture angles ($\phi_1^{ref}$, $\phi_2^{ref}$) of the boom 1 and the arm 3.

Incidentally, by preliminarily storing the correspondence between ($x_p^{ref}$, $y_p^{ref}$) and ($\phi_1^{ref}$, $\phi_2^{ref}$) into a memory table and reading out ($\phi_1^{ref}$, $\phi_2^{ref}$) corresponding to the parameters from the memory table using ($x_p^{ref}$, $y_p^{ref}$) as a parameter, the transforming calculation can be substituted.

At step 305 shown in FIG. 15, the operation expressed by the equations (4), (5), (6), (7), (8) and (9) are executed at each sampling time $\Delta T$ so as to obtain the reference posture angles $\phi_1^{ref}$ and $\phi_2^{ref}$ of the first boom 1 and the second boom 2 and the deviation angles $\Delta\phi_1$ and $\Delta\phi_2$ of the first boom 1 and the second boom 2 detected by the potentiometers from the reference posture angles $\phi_1^{ref}$ and $\phi_2^{ref}$ are calculated. Then, at step 306, a control signal corresponding to the deviation angle $\Delta\phi_1$ is supplied to the servo valve 51, and the control signal corresponding to the deviation angle $\Delta\phi_2$ is supplied to the servo valve 52.

The output pressure of the servo valve 51 acts on the first boom actuating operational valve 28 via the electromagnetic selector valves 53A or 53B switched at step 301. The output pressure of the servo valve 52 acts on the second boom operating operation valve 36 via the shuttle valves 54A and 54B as a pilot pressure.

Accordingly, for example, when only the lever 15 is operated in the right-and-left direction, the first boom cylinder 11 or the second boom cylinder 12 is extended or contracted such that the connection point P is moved straightway in the x direction. When only the lever 16 is operated in the back-and-forth direction, these cylinders 11 and 12 are extended or contracted such that the connection point P is moved straightway in the y direction. In these cases, the velocity of the connection point P corresponds to the operated amount of the levers 15 and 16.

On the other hand, by operating simultaneously the lever 15 in the left-and-right direction and the lever 16 in the back-and-forth direction, the connection point P is moved according to the direction and the speed designated by the velocity vector ($V_x^{ref}$, $v_y^{ref}$).

As mentioned above, in this embodiment, since the connection point P can be moved in the y direction by operating the lever 16, when executing the corner digging, it is not necessary to operate the first boom 1 and the second boom 2 directly. Accordingly, since the burden of an operator is lightened and the connection point P does not vary in the x direction, improved digging is achieved.

In this embodiment, when digging a transversal straight ditch as shown in FIG. 7, the position of the connection point P in the x direction can be varied only by operating the lever 15. Accordingly, it is not necessary to operate the first boom 1 and the second boom 2 directly, thereby not only lightening the burden of the operator, but also obtaining flat dug surfaces since the connection point P does not move in the y direction during this operation.

Furthermore, in this embodiment, since the cutting edge of the bucket 4 can be moved along a target line by simultaneously operating the levers 15 and 16, normal digging can be carried out appropriately and effectively. More particularly, by operating the levers 15 and 16 such that the reference velocities of the connection point P $V_x^{ref}$ and $V^{ref}_y$ are set to be equal, i.e., $V_x^{ref}=-V_y^{ref}$, a normal surface having an inclination of 45° can be made.

Incidentally, in this embodiment, as shown at steps 302 to 304, the operations to maintain the angle of the arm 3 with respect to the horizontal plane to the target angle $\theta_r$ are executed concurrently with the above operations.

At step 307 shown in FIG. 15, a judgment is made as to whether or not the switch 164 shown in FIG. 10 is turned on. When it is judged that the switch 164 is not turned on, flag F is set to "0" so that the procedure is returned to step 300. When it is judged that the microswitch 164 is turned on, procedures similar to those of steps 202 to 207 are executed at the controller 30 (steps 309 to 314). Accordingly, in this embodiment, the cutting edge of the bucket 4 is also controlled to be kept to the fixed direction by turning on the switch 164.

Although in the above-mentioned embodiment, the target destination of the connection point P is calculated at respective sampling times $\Delta T$, the connection point P ($X_p$, $Y_p$) can be moved as follows.

The reference angular velocities $\dot{\phi}_1^{ref}$ of the first boom 1 and $\dot{\phi}_2^{ref}$ of the second boom 2 to move the connection point P in the x direction at the reference velocity $V_x^{ref}$ shown by the output of the potentiometer 45 are expressed by the following equations respectively.

$$\phi_1^{ref} = \frac{l_2\cos(\phi_1 + \phi_2)}{l_1 l_2 \sin\phi_2} \times V_x^{ref} \quad (10)$$

$$\phi_2^{ref} = -\frac{l_1\cos\phi_1 + l_2\cos(\phi_2 + \phi_2)}{l_1 l_2 \sin\phi_2} \times V_x^{ref} \quad (11)$$

The angular velocities $\dot{\phi}_1^{ref}$ and $\dot{\phi}_2^{ref}$ to move the connection point P in the y direction at the reference velocity shown by the output of the potentiometer 46 are expressed by the following equations respectively.

$$\phi_1^{ref} = -\frac{l_1\sin\phi_1 + l_2\sin(\phi_1 + \phi_2)}{l_1 l_2 \sin\phi_2} \times V_y^{ref} \quad (12)$$

$$\phi_2^{ref} = -\frac{l_1\sin\phi_1 + l_2\sin(\phi_1 + \phi_2)}{l_1 l_2 \sin\phi_2} \times V_y^{ref} \quad (13)$$

Therefore, by forming commanding signals corresponding to the angular velocities $\dot{\phi}_1^{ref}$ and $\dot{\phi}_2^{ref}$ expressed by the equations (10) and (11) on the basis of the output of the potentiometer 45 and applying these signals to the servo valves 51 and 52 respectively, the connection point P can be moved in the x direction at the reference velocity $V_x^{ref}$ designated by the lever 15. Further, by forming commanding signals corresponding to the angular velocities $\dot{\phi}_1^{ref}$ and $\dot{\phi}_2^{ref}$ expressed by the equations (12) and (13) on the basis of the output of the potentiometer 46 and applying the signals to the servo valves 51 and 52 respectively, the connection point P can be moved in the x direction at the reference velocity $V_y^{ref}$ designated by the lever 16. Consequently, by means of simultaneous operation of the levers 15 and 16 in the abovementioned directions, the connection point P can be moved at the speed and in the direction designated by the velocity vector ($V_x^{ref}$, $V_y^{ref}$).

Incidentally, when moving the connection point P as described above, at step 305 shown in FIG. 15, operations expressed by the equations (12) and (13) executed and commanding signals corresponding to $\dot{\phi}_1^{ref}$ and $\dot{\phi}_2^{ref}$ are formed at step 305 shown in FIG. 15.

Alternatively, the connection point P can be moved as follows.

In order to move the connection point P in the x direction without varying the y-direction position $y_p$ of the connection point P, $\phi_1$ and $\phi_2$ are only to be varied so that $y_p$ of the equation (5) may be constant. Further, in order to move the connection point P in the y-direction without varying the x-direction position $x_p$ of the connection point P, $\phi_1$ and $\phi_2$ are only to be varied so that $x_p$ of the equation (4) may be kept constant.

Therefore, by varying the posture angle $\phi_1$ of the first boom 1 on the basis of the output of the potentiometer 45, while controlling the second boom cylinder 12 such that the second boom 2 may take a posture in which the posture angle is $\phi_2$($\phi_2$ being obtained from equation (5)), to make $y_p$ constant, the connection point P can be moved in the x direction.

By varying the posture angle $\phi_1$ of the first boom on the basis of the output of the potentiometer 46, while controlling the second boom cylinder 12 such that the second boom may take a posture in which the posture angle is $\phi_2$($\phi_2$ being obtained from the equation (4)) to make $x_p$ constant, the connection point P can be moved in the y direction.

Figure 16:
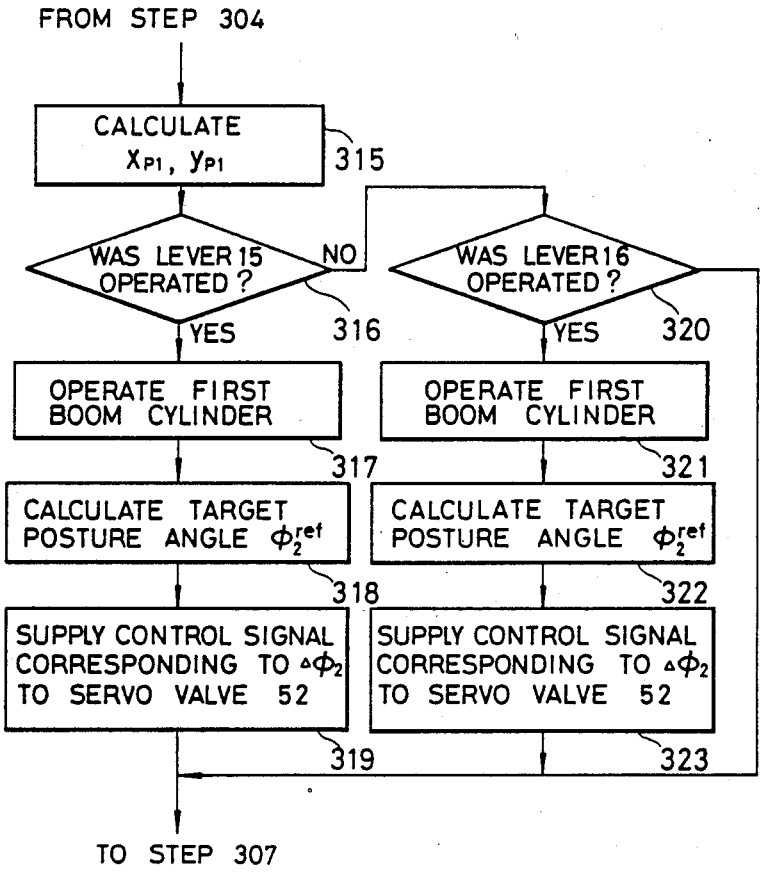
FIG. 16 is a flowchart showing another embodiment of the fourth aspect of this invention.

When moving the connection point P in the x direction or in the y direction as described above, the procedures shown in FIG. 16 are executed instead of steps 305 and 306 shown in FIG. 15.

More particularly, the current position $x_{pl}$ and $y_{pl}$ of the connection point P are calculated based on the equations (4) and (5) (step 315), and a judgment is made as to whether or not the lever 15 is operated based on the presence or absence of the output from the potentiometer 45 (step 316). When it is judged that the lever 15 is operated, the first boom cylinder 11 is operated by a signal based on the output of the potentiometer 45 (step 317), and the reference posture angle $\phi_2^{ref}$ of the second boom 2 for keeping the y direction of the connection point P is calculated based on the equation (5) (step 318).

Then, the deviation $\Delta\phi_2$ of the current posture angle $\phi_2$ of the second boom 2 from the reference posture angle $\phi_2^{ref}$ is calculated and the control signal corresponding to the deviation $\Delta\phi_2$ is supplied to the servo valve 52 (step 319).

When the result of the judgment at step 316 is NO, a judgment is made as to whether or not the lever 16 is operated based on the presence or absence of the output from the potentiometer 46 (step 320). When it is judged that the lever 16 is operated, the first boom cylinder 11 is operated based on the output of the potentiometer 46 (step 321), and the reference posture angle $\phi_2^{ref'}$ of the second boom 2 for keeping the x-direction position of the connection point P to $x_{pl}$ is calculated based on the equation (4) (step 322).

Then, the deviation $\Delta\phi_2'$ between the reference posture angle $\phi_2^{ref'}$ and the current posture angle $\phi_2$ of the second boom 2 is calculated, and the control signal corresponding to the deviation is supplied to the servo valve 52 (step 323).

By executing the above procedure, when the lever 15 is operated, the connection point P is moved only in the x direction, and when the lever 16 is operated, the connection point P is moved only in the y direction.

On the contrary, it may be so constructed that the posture angle $\phi_2$ of the second boom 2 is varied by means of the operation of the lever 15 or the lever 16 while controlling the posture angle $\phi_1$ of the first boom 1 so as to keep the position of the connection point P to $y_{pl}$ or $x_{pl}$ regardless of the variation of the posture angle $\phi_2$.

Further, it may be constructed that the posture angle $\phi_1$ of the first boom 1 is varied by means of the operation of the lever 15 while controlling the posture angle $\phi_2$ of the second boom 2 by means of the lever 16. In this case, the posture angle $\phi_2$ of the second boom 2 is controlled such that the y-direction position of the connection point P may be held to $y_{p1}$ and the posture angle $\phi_1$ of the first boom 1 is controlled such that the x-direction position of the connection point P may be held to $x_{p1}$ during the operation of the lever 16.

In the above embodiment, the moving command for moving the connection point P during the automatic mode is produced from the potentiometers 45 and 46 linking to the levers 15 and 16. However, it is possible to provide an electric lever dedicated to this moving command.

Furthermore, it is possible to use a mono-lever type device such as a joy stick. With such device, the operation becomes easier because the connection point P can be moved in the direction in which the lever is inclined.

Availability of this Invention in the Industrial Field

According to this invention, an arm cylinder is automatically controlled such that the posture angle of the arm may be made to be a reference posture angle. Accordingly, corner portions and the like are appropriately dug without arm posture angle correcting operations, thereby deceasing operator's burden and facilitating digging operation.

Furthermore, according to this invention, since the cutting edge of the bucket 4 can be held toward the constant direction, it is unnecessary to carry out the operation for rotating the arm when executing transversal straight digging and the like, thereby decreasing the burden of an operator and enhancing the working efficiency.

Furthermore, according to this invention, since the connection point between the second boom and the arm can be moved in desired directions, corner digging and bank cutting can be executed effectively and appropriately.

What is claimed is:

1. A control device for use in a power shovel having an upper revolving superstructure, a first boom having a base end pivotably connected to said upper revolving superstructure, and a fore end, a second boom having a base end pivotably connected to said fore end of the first boom, and a fore end and an arm comprising a base portion pivotably connected said fore end of the second boom, and a rotatable portion rotatable around the longitudinal axis thereof, comprising:

angle detecting means for detecting the respective posture angles of said first boom with respect to a horizontal plane, said second boom with respect to said first boom and said arm with respect to said second boom;

posture angle calculating means for calculating a posture angle of said arm with respect to said horizontal plane based on output of said angle detecting means;

reference angle setting means for setting a reference posture angle of said arm with respect to said horizontal plane; and arm cylinder control means for controlling an arm cylinder so as to bring the posture angle of said arm to said reference posture angle.

2. A control device for a power shovel as set forth in claim 1, further comprising a switch for setting an automatic mode, said arm cylinder being controlled when and only when said switch sets the automatic mode.

3. A control device for a power shovel as set forth in claim 2, wherein said switch is mounted to a grip portion of an operation lever.

4. A control device for use in a power shovel having an upper revolving structure, a first boom having a base end pivotably connected to said upper revolving superstructure, and a fore end, a second boom having a base end pivotably connected to said fore end of the first boom, and a fore end, an arm comprising a base portion pivotably connected to said fore end of the second boom, and a rotatable portion rotatable around the longitudinal axis thereof and a bucket pivotably connected to said rotatable portion of the arm, comprising:

revolution angle detecting means for detecting revolution angle of said arm around said longitudinal axis thereof;

rotation angle detecting means for detecting the rotation angle of said upper revolving superstructure;

calculating means for calculating deviation angle $\Delta A$ between the initial direction and current direction of the cutting edge of said bucket based on outputs of said revolution angle detecting means and said rotation angle detecting means; and arm revolution angle control means for controlling an acuator for rotating said arm so as to make said deviation angle $\Delta A$ zero.

5. Control device for a power shovel as set forth in claim 4, wherein said calculating means comprises means for subtracting rotation angle $\Delta\beta$ of said upper revolving superstructure rotated from the initial rotation angle $\beta_0$ thereof from the initial rotation angle $\alpha_0$ of said arm so as to obtain reference revolution angle of said arm, and means for subtracting an actual rotation angle $\alpha$ of said arm from said reference angle so as to obtain said deviation angle $\Delta A$.

6. A control means for a power shovel as set forth in claim 4, further comprising a switching means for setting an automatic mode, said actuator being controlled when and only when said switch sets the actuator mode.

7. A control device for use in a power shovel having an upper revolving superstructure, a first boom having a base end pivotably connected to said upper revolving superstructure, and a fore end, a second boom having a base end pivotably connected to said fore end of the first boom, and a fore end, and an arm comprising a base portion pivotably connected to said fore end of the second boom, and a rotatable portion rotatable around an longitudinal axis thereof, comprising:

angular velocity detecting means for detecting rotational angular velocity of said upper revolving superstructure; and arm rotation control means for controlling the rotation of said arm so as to be in the angular direction reverse to the rotating direction of the upper revolving superstructure and at said angular velocity of said upper revolving superstructure.

* * * * *